US008678710B2

(12) United States Patent
Dos Santos

(10) Patent No.: US 8,678,710 B2
(45) Date of Patent: Mar. 25, 2014

(54) RAINWATER CHANNEL DRAIN

(76) Inventor: Maurcio Santiago Dos Santos, Niteroi (BR)

( * ) Notice: Subject to any disclaimer, the term of this patent is extended or adjusted under 35 U.S.C. 154(b) by 0 days.

(21) Appl. No.: 13/382,003

(22) PCT Filed: Jun. 29, 2010

(86) PCT No.: PCT/BR2010/000203
§ 371 (c)(1),
(2), (4) Date: Jan. 3, 2012

(87) PCT Pub. No.: WO2011/003159
PCT Pub. Date: Jan. 13, 2011

(65) Prior Publication Data

US 2012/0099927 A1 Apr. 26, 2012

(30) Foreign Application Priority Data

Jul. 6, 2009 (BR) ..... 0902331

(51) Int. Cl.
*E01F 5/00* (2006.01)
*E03F 1/00* (2006.01)

(52) U.S. Cl.
USPC ..... 405/118; 405/119; 405/221

(58) Field of Classification Search
USPC ..... 405/80, 118, 119, 121–123; 404/2–3; 249/10–11
See application file for complete search history.

(56) References Cited

U.S. PATENT DOCUMENTS

| | | | | | |
|---|---|---|---|---|---|
| 229,576 | A * | 7/1880 | Adams et al. | 217/4 |
| 2,444,688 | A * | 7/1948 | Wilson | 405/119 |
| 4,515,498 | A * | 5/1985 | Thomann et al. | 404/4 |
| 4,815,888 | A * | 3/1989 | Stegmeier | 404/4 |
| 5,106,231 | A * | 4/1992 | Thomann | 405/119 |
| 5,135,331 | A * | 8/1992 | Steiner | 404/2 |
| 5,181,793 | A * | 1/1993 | Dekel | 404/4 |
| 5,971,662 | A * | 10/1999 | Becker et al. | 405/119 |
| 6,113,311 | A * | 9/2000 | Becker et al. | 405/119 |
| 6,132,137 | A * | 10/2000 | Gunter | 405/36 |
| 6,942,424 | B2 * | 9/2005 | Charon | 405/118 |
| 7,736,092 | B2 * | 6/2010 | Hodgekins et al. | 405/119 |
| 2002/0057945 | A1 * | 5/2002 | Dahowski et al. | 405/118 |
| 2004/0136785 | A1 * | 7/2004 | Gunter | 405/118 |
| 2004/0240941 | A1 * | 12/2004 | Sieber et al. | 405/118 |
| 2005/0281619 | A1 * | 12/2005 | Humphries et al. | 405/118 |
| 2006/0159520 | A1 * | 7/2006 | Charon | 405/118 |

* cited by examiner

*Primary Examiner* — Benjamin Fiorello
(74) *Attorney, Agent, or Firm* — Caesar, Rivise, Bernstein, Cohen & Pokotilow, Ltd.

(57) ABSTRACT

A channel (1) is disclosed for use in the field of basic sanitary services, more specifically to a pre-moulded channel for rainwater draining systems, developed to satisfy the surface drainage needs of hydrographic basins and urban areas of growing density. The disclosed channel (1) does not require a stabilized ground, can operate at the surface of roads, allowing traffic to circulate and the road section used to be paved, can use modules of variable lengths, and can even serve, when already in use, as a street surface. The channel (1) comprises four basic pre-moulded modular elements made of reinforced concrete or pre-stressed concrete, i.e.: guide cradle (2), bottom (3), walls (4) and (5) and cover (6), of variable dimensions depending on the projected collecting system.

7 Claims, 5 Drawing Sheets

RAINWATER CHANNEL DRAIN

TECHNICAL FIELD

The present invention refers to a channel to be used in the area of basic sanitation services, more specifically a precast channel for rainwater drainage systems, developed to meet the needs of watershed runoff and urban population density growth of the various developing nuclei.

STATE OF THE ART

A law was recently passed in Brazil providing for the universalization of basic sanitation services, including water, sewer and storm drainage, and garbage collection.

In this process where the hydrologic cycle waters begin to runoff, an entire process of urban breakdown starts, from the contamination of aquifers and groundwater, affecting water quality of a process that is vital to the survival of human life.

Starting with rainfall, the hydrological cycle is completed in phases: evaporation and transpiration; infiltration; absorption and underground flow; and runoff. Of the total volume of rainfall, one part is intercepted by vegetation, while the rest reaches the ground surface. The accumulation of water in depressions on the ground surface begins to occur only when the rainfall intensity exceeds the infiltration rate, or when the storage capacity of water on the ground is exceeded. Having exhausted the surface retention capacity, the water will start to drain.

The assessment or determination of how much water is flowing on the surface as a result of rains is of great interest for solving various engineering problems, among which are rainwater drainage sizing projects for urban areas, with the development of a surface water hydrograph and hydrologic modeling.

The natural hydrologic cycle consists of various physical, chemical and biological processes. When people act on this system and focus on space, significant changes will occur, with drastic consequences to this cycle and significant impacts (often irreversibly) to people themselves and nature.

As water is the basis of sanitation, one can understand the perverse results of this operation: each year it becomes more difficult to access the water and quantity needed. Consequently, there is a decrease in the possibility of sanitation and an increase in the risk of disease and death.

The development of cities in developing countries has been occurring with moderate coverage of sewage networks in addition to the almost total lack of sewage treatment. As the city grows and investments in the system are not made, the sewage from different sources is connected to the rainwater. This flow, in turn, converges to the urban rivers and the river system downstream, resulting in negative impacts on water quality that are well known.

Currently, the collecting systems use various elements, such as:

- Precast reinforced or simple concrete pipes, with rigid or elastic joint seal, bag and tip and male and female type, made according to Brazilian standard NBR 8890/07, and pipes of special classes (high resistance), used for storm water;
- cellular gallery consisting of concrete staves together with rigid male and female joint, with square or rectangular sessions, closed and open, type (U) or (L), custom manufactured according to customer's design, or even manufactured based on information about height of landfill, soil type and basic type of traffic that will fall on parts used in the channeling of streams, water courses and stormwater drainage, and may also perform the function of bridges;
- oval pipe with rigid tip and bag joint type, made to order according to landfill height and traffic, also used in stormwater drainage, channelization of streams, cattle crossing or pedestrian crossing, suitable for works requiring high strength due to the great height of landfill; and
- pipes for driving, which is a high strength concrete pipe used in the method of tunnels through driving, in which the pipe is driven by hydraulic jacks and nailed to the ground. With the advance of the machine, the stretch already run is used to support the positioning of the new pipe. This method requires high technology and there are few industries capable of manufacturing them. This system is suitable for rainwater drainage, sewerage, plumbing and electricity and telephone line conduits in all types of grounds.

Depending on gravity and the characteristics of the elements actually used, rainwater collection systems are compromised and limited by levels, creating the need for using pumping stations. In addition, due to limitations of elements responsible for implementing the collecting systems (hydrological modeling and the elements actually used), said systems rely on stabilized landfill for their protection, the greater the train-type, the more stable will be the collecting system. Yet, as these collection systems use small elements, which typically range from 1.0 to 1.5 m of linear length, the systems performance process becomes repetitive and flawed. It should be added also that the weight of the elements makes them difficult to launch and level, making it extremely difficult to launch them for assembly and horizontal offset for pieces and their modules to fit.

SUMMARY OF THE INVENTION

It is the aim of the present invention to propose a channel for a rainwater drainage system developed to eliminate the drawbacks mentioned above, in particular, provide collection systems that do not rely on stabilized landfill to protect them and that beat the efforts of the various train-type.

Another objective of the present invention is to propose a rainwater drainage system channel developed to allow collection systems to work on the surface of city streets or rural areas.

Another objective of the present invention is to propose a rainwater drainage system channel developed to allow, if required, traffic and paving of section where collection systems are being implemented.

It is also another objective of the present invention to propose rainwater drainage system channel developed to allow collecting systems to use modules that may vary in length, depending on the needs of the project.

As can be inferred from reading this report, the channel that is object of this invention incorporates, considering its executive process, the numerous advantages mentioned above in relation to precast elements conventionally presented and used in rainwater drainage systems. The channel does not depend on stabilized landfills, and one can work on the surface of causeways, allowing traffic and paving in the stretch being implemented, and modules of different lengths can be used. The finished product, i.e., the channel already implemented, may also be used as floor for urban traffic (train-type class 45, set forth in ABNT NB-6, 1982, and registered with SINMETRO as NBR-7188).

For the development of the channel object of this invention, various technical aspects were taken into account, such as construction process, speed of execution and installation, cost-effectiveness, large flows, ideal hydraulic section to hold a laminar flow at low, medium and high flows, low maintenance, among others.

The channel geometry was designed and presents an ideal hydraulic section, in compliance with speed chart for channels and galleries, making it self-cleaning and not prone for residue deposits that may obstruct the water flow, thus ensuring low maintenance cost. Additionally, as the height is the same of the double reinforced road tube currently used in rainwater drainage systems, the channel object of the present invention provides a final flow that is 20% higher.

The system using the channel that is object of the present invention has, also, other significant advantage, i.e., it uses characteristics of preformed parts produced individually, they are isostatic, to covert them after assembly into hyperstatic structures, strongly consolidated as any conventional structure, producing a completely sealed and static system.

The system consists of preformed modules, which are highly useful, practical, and functional for the intended use, and comprise a system in which important technology improvements were introduced for the activity, imparting several technical and economic advantages.

DETAILED DESCRIPTION

The channel (1) in the current invention consists of four basic modular elements of pre-cast reinforced or prestressed concrete, i.e: cradle guide (2), bottom (3), preferably in prestressed and high performance concrete, walls (4) and (5) with variable heights according to level requirements, and cover (6), which may be for road use, ribbed, and preferably in prestressed and high performance concrete. The dimensions of the elements vary depending on the collector system design. As an example, we have a collection system with a round bottom (3) in prestressed concrete with 10 m length, a cover (6) in prestressed concrete with 2 m linear and with 4.5 m support, and walls (4) and (5) with 2.5 m wide with varying heights as requested to meet level requirements Therefore, in one of the forms of the invention, for example, to builds a 10 m channel, a round bottom (3) with 10 m length is used, with five cradle guide (2), eight walls (4) and (5) and five road covers (6).

Figure 1:
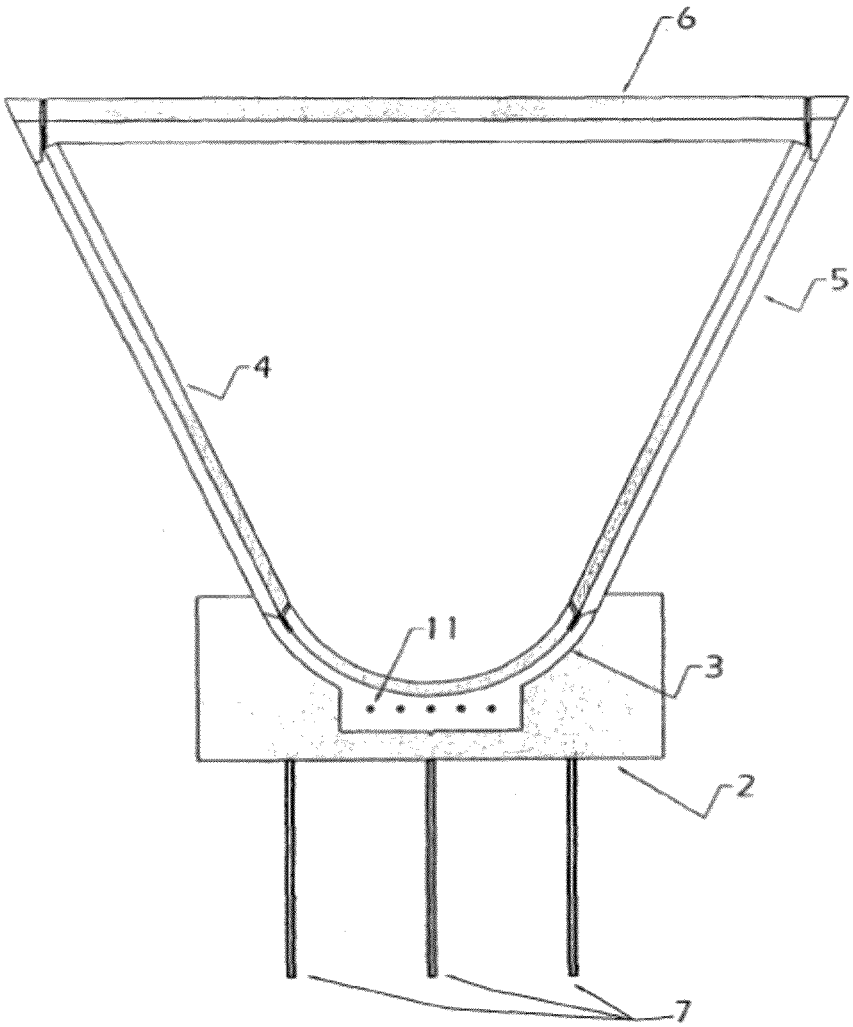
FIG. 1 is a front cutaway view of the channel (1) object of the present invention, a result from the assembly of its basic elements: cradle guide (2), round bottom (3), prestressed, walls (4) and (5) and road cover (6), prestressed.
Figure 2:
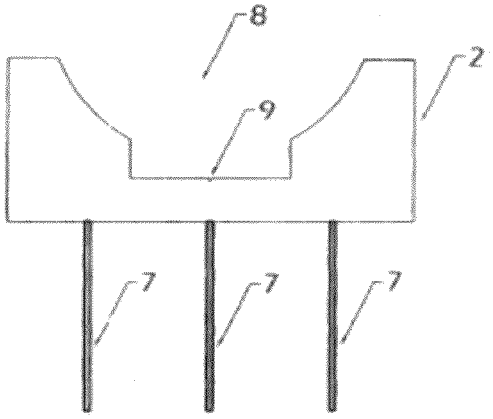
FIG. 2 is a front view of the cradle guide (2), which is provided with variable clamping rod (7) and inner surface (8) with suitable shape for a perfect settling of bottom (3) and a guiding slot on the bottom (9) for topographic orientation.
Figure 3:
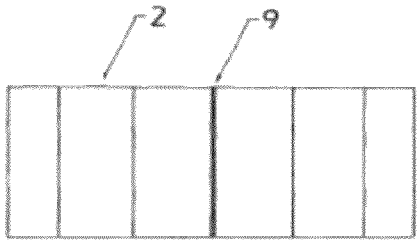
FIG. 3 is a top view of the cradle guide (2).
Figure 4:
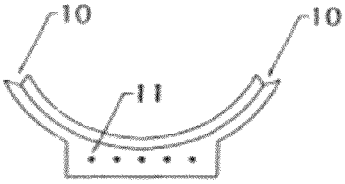
FIG. 4 is a front view of the bottom (3), whose upper edges are provided with surfaces (10) of female type for perfect settling and grouting of walls (4) and (5) to the bottom (3), as well as prestressing elements (11).
Figure 5:
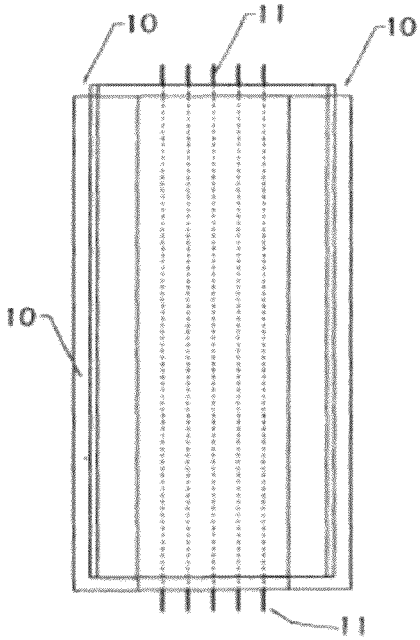
FIG. 5 is a top view of the bottom (3).
Figure 6:
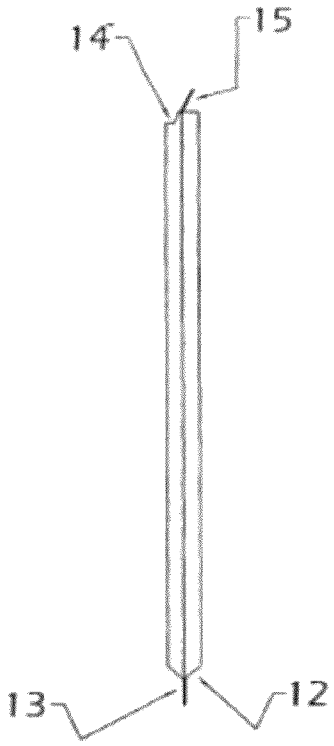
FIG. 6 is a front view of the wall (4), whose lower end is provided with male type surface (12) and metal rods (13) for perfect settling and grouting to bottom (3) and, at the upper end, a female type surface (14) with metal rods (15) for perfect settling and grouting to cover (6).
Figure 7:
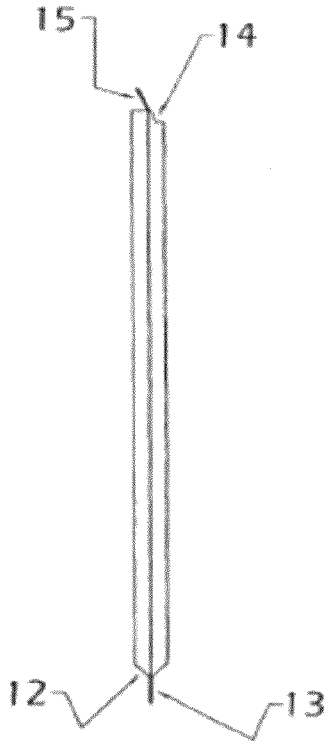
FIG. 7 is a front view of the wall (5), whose lower end is also provided with male type surface (12) and metal rods (13) for perfect settling and grouting to bottom (3) and, at the upper end, a female type surface (14) with metal rods (15) for perfect settling and grouting to cover (6).
Figure 8:
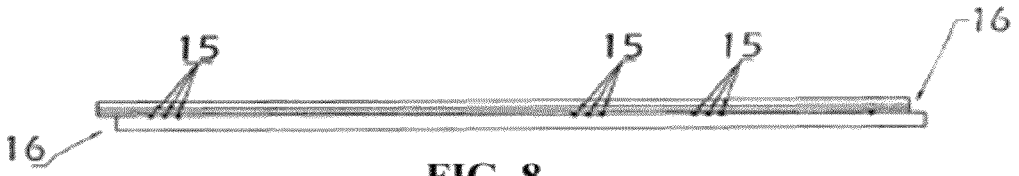
FIG. 8 is a top view of the wall (4) showing the metal rods (15) and male and female type surfaces (16) for perfect settling and grouting of one wall (4) to the other.
Figure 9:
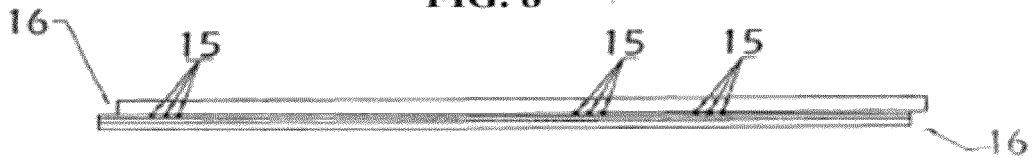
FIG. 9 is a top view of the wall (5) showing the metal rods (15) and male and female type surfaces (16) for perfect settling and grouting of one wall (5) to the other.
Figure 10:
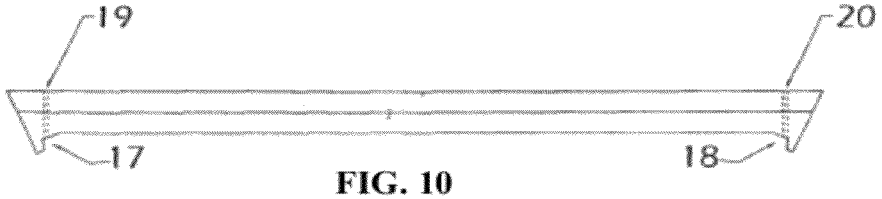
FIG. 10 is a front view of the cover (6), whose ends are provided with surfaces (17) and (18) of female type for perfect settling and grouting to walls (4) and (5) and holes (19) and (20), where the metal rods (15) of walls (4) and (5) will be installed.
Figure 11:
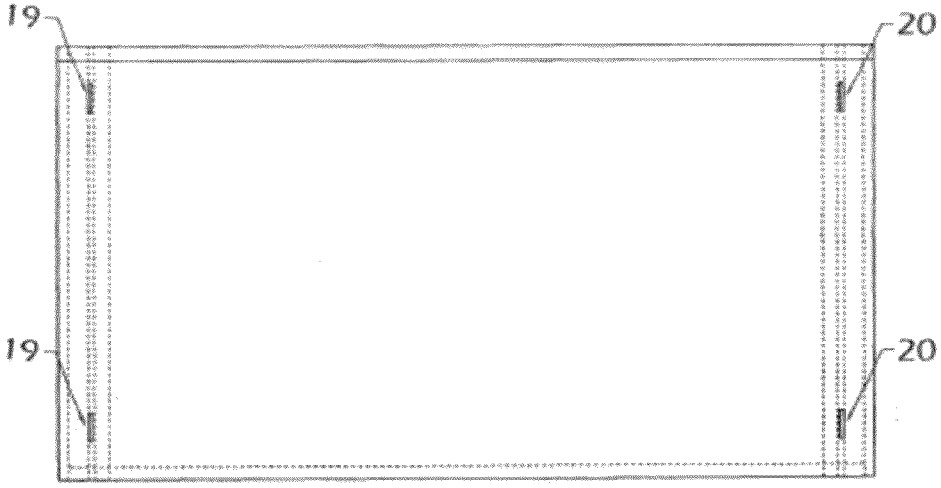
FIG. 11 is a top view of the cover (6) showing the holes (19) and (20) where they the metal rods (15) of walls (4) and (5) will be installed.
Figure 12:
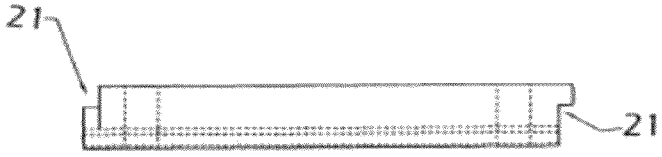
FIG. 12 is a side view of the cover (6) showing the surfaces (21) of male and female type for perfect settling and grouting of one cover (6) to the other.
Figure 13:
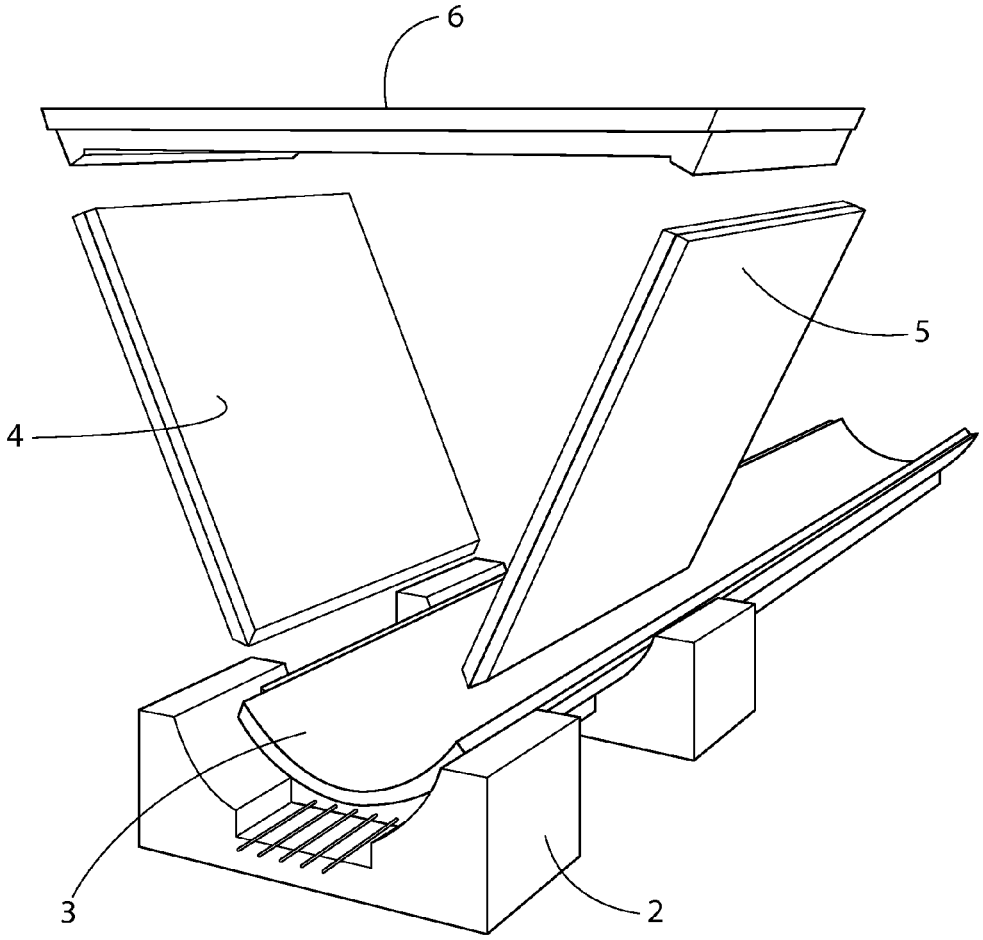
FIG. 13 is an exploded view in perspective of a channel mode (1).

Parts or elements of the channel are premolded in reinforced concrete or prestressed reinforced concrete, or high performance concrete, allowing the manufacture of long, light, and thin parts, which improve the gallery construction process for urban and rural waters drain flow, as its process and design are radically different from those currently being used.

The cradle guide modules (2), in reinforced concrete, are elements designed to receive the round bottom (3) and enable the necessary monitoring of levels, as they will be seated with the aid of topography and the guide slot (9), and designed so as to function as channel foundation and stabilization element (1), not allowing any form of differential pumping, and enabling walls bracing near the round bottom (3). Cradle guides (2) may be settled with a distance between them varying according to project requirements, preferably every 2.5 m.

Bottom modules (3) are preferably made of prestressed concrete and with high performance concrete technology, with round internal surface, with variable length according to project requirements, preferably between 5 and 10 m, in order to be used in longer sections with less elements.

After the round bottoms (3) required for the several sections are released, they are covered with earth to stabilize the sub base and, after that, the process to launch the walls (4) and (5) is initiated. These releases will also be tracked and monitored by the topography, which give the perfect opening for covers (6) support spans. Once the ideal position according to project is found, walls are locked by anchor hooks available in on round bottom (3), in order to stabilize them. Then begins the re-fill of digs, until the threshold level of the walls (4) and (5), re-filling and compacting the sides of the channel (1), to install respective covers (6), which will be grouted to the wall (4) and (5) after launching.

The object of this invention application can be applied in plumbing systems of streams, rivers, urban and rural watersheds, in operation carried out quickly and economically, with each project tailored to the needs of rainwater flow to be channeled according to region, rainfall and other requirements, adjusting the size of the pieces in order to obtain a feasible, economical, and technically perfect work. After opening the digs on ground, with the help of the topography, one can level and stabilize the site to guide the settlement of the cradle (2) that will receive the round bottom (3) according to heights required to maintain the water flow provided for in hydrograph. If necessary, cement cream can be injected in the bed to provide stabilization.

Therefore, we see that the channel in this invention has technical, practical, functional, and economical advantages provided by preformed channel modules, whose own characteristics are innovative, with a different way to implement its hydraulic section, as well as the optimization by size of its elements, which are only four and perfectly matching, and which during the assembly process with grouting will form a hydraulically optimal collection system.

The invention claimed is:

1. A channel drainage system for rainwater comprising:

a cradle guide;

a bottom;

walls; and a cover, wherein:

the cradle guide comprises: (a) variable clamping rods, (b) an inner surface with a format suitable for receiving the bottom, and (c) a guide slot on a bottom of the cradle guide for topographic orientation;

the bottom comprises: (a) female type surfaces on upper ends of the bottom for settling and grouting of the walls to the bottom, and (b) prestressing elements;

the walls comprise: (a) male type surfaces and metal rods on lower ends of the walls for settling and grouting of the walls to the bottom, (b) male type surfaces and metal rods on upper ends of the walls for settling and grouting of the walls to the cover, and (c) male and female type surfaces for settlement and grouting of the walls to other walls; and the cover comprises: (a) female type surfaces on edges of the cover for settling and grouting of the cover to the walls, (b) holes for receiving the metal rods of the walls, and (c) male and female type surfaces for settling and grouting of the cover to another cover.

2. The channel drainage system according to claim 1, wherein the bottom has a circular section.

3. The channel drainage system according to claim 1, wherein the bottom has a length of 5 to 10 meters.

4. The channel drainage system according to claim 3, wherein the bottom has a circular section.

5. The channel drainage system according to claim 4, wherein the bottom is constructed of prestressed concrete.

6. The channel drainage system according to claim 1, wherein the bottom is constructed of prestressed concrete.

7. The channel drainage system according to claim 1, wherein the cover is ribbed.

* * * * *